US009348258B2

(12) United States Patent
Xu

(10) Patent No.: US 9,348,258 B2
(45) Date of Patent: May 24, 2016

(54) DEVELOPING UNIT

(71) Applicant: Brother Kogyo Kabushiki Kaisha, Nagoya-shi, Aichi-ken (JP)

(72) Inventor: Fan Xu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/491,209

(22) Filed: Sep. 19, 2014

(65) Prior Publication Data

US 2015/0086237 A1 Mar. 26, 2015

(30) Foreign Application Priority Data

Sep. 20, 2013 (JP) ..... 2013-195379

(51) Int. Cl.
*G03G 15/00* (2006.01)
*G03G 15/08* (2006.01)

(52) U.S. Cl.
CPC ..... *G03G 15/0817* (2013.01); *G03G 15/0881* (2013.01); *G03G 15/0808* (2013.01)

(58) Field of Classification Search
CPC ..... G03G 15/0808; G03G 15/0881
See application file for complete search history.

(56) References Cited

U.S. PATENT DOCUMENTS

| | | | | |
|---|---|---|---|---|
| 6,070,027 | A * | 5/2000 | Kawai et al. | 399/103 |
| 6,792,227 | B2 | 9/2004 | Itabashi | |
| 2002/0141778 | A1 | 10/2002 | Itabashi | |
| 2013/0287431 | A1 * | 10/2013 | Fukamachi et al. | 399/103 |

FOREIGN PATENT DOCUMENTS

| | | | |
|---|---|---|---|
| JP | H09-274380 | A | 10/1997 |
| JP | 2002-287488 | A | 10/2002 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A developing unit includes a housing, a developing roller and a seal contacting an outer peripheral surface of the developing roller. The seal includes a first part disposed inward in an axial line direction of the developing roller and contacting the outer peripheral surface of the developing roller, and a second part contacting an outer edge of the first part in the axial line direction and disposed outward from the first part in the axial line direction and contacting the outer peripheral surface. The first part has a contact surface contacting the developing roller and a plurality of first grooves each of which is recessed from the contact surface and extends along the contact surface. The plurality of first grooves extends from outward to inward in the axial line direction, as the plurality of first grooves extends from upstream to downstream in a rotational direction of the developing roller.

16 Claims, 13 Drawing Sheets

DEVELOPING UNIT

CROSS-REFERENCE TO RELATED APPLICATION

This application claims priority from Japanese Patent Application No. 2013-195379, filed on Sep. 20, 2013, which is incorporated herein by reference in its entirety.

TECHNICAL FIELD

Aspects disclosed herein relate to a developing unit mounted to an image forming apparatus which employs electrophotography.

BACKGROUND

There are known developing devices used in electrophotographic image forming apparatuses having an image carrying member on which is formed an electrostatic latent image, a developing agent carrying member which supplies a developing agent to the image carrying member, and a seal member which is in tight contact with the developing agent carrying member. The developing agent carrying member is generally columnar in shape. The seal member is disposed between the housing of the developing device and a shaft end portion of the developing agent carrying member, and slides over the outer perimeter face of the developing agent carrying member during developing operations. External leakage of developing agent from the shaft end portion of the developing agent carrying member is prevented by the seal member.

There is known such a developing device which has a developing roller as the developing agent carrying member, with a groove formed on the surface of the seal member serving as the face of contact as to the developing roller. The groove on the seal member is configured so as to cause toner to move to the middle portion of the developing roller in the axial line direction, due to rotations of the developing roller. Accordingly, even if toner works its way into between the developing roller and seal member during developing operations, the toner is guided to the middle side of the developing roller in the axial line direction by the groove in the seal member, due to rotations of the developing roller, and is returned into the housing.

SUMMARY

With such image forming apparatus, applying impact to the developing device may cause toner to leak from the developing device. In a case where the developing device is detachably mounted to the image forming apparatus for example, the user may accidentally drop the developing device while performing operations of mounting/detaching the developing device to/from the image forming apparatus. Also, the developing device may be subjected to impact during maintenance work on the image forming apparatus. A gap may form between the seal member and the developing roller at this time, and toner may leak from this gap.

Accordingly, it is an object of the present invention to provide a developing unit which can suppress leakage of developing agent in a sure manner.

According to one or more aspects of the disclosure, a developing unit may include a housing configured to accommodate therein a developing agent, a developing roller disposed in the housing and configured to rotate on a first axial line, and a seal disposed in the housing and contacting an outer peripheral surface of the developing roller. The seal may include a first part disposed inward in an axial line direction of the developing roller and contacting the outer peripheral surface of the developing roller, and a second part contacting an outer edge of the first part in the axial line direction and disposed outward from the first part in the axial line direction and contacting the outer peripheral surface of the developing roller. The first part may have a contact surface contacting the developing roller and a plurality of first grooves each of which is recessed from the contact surface and extends along the contact surface. The plurality of first grooves may extend from outward to inward in the axial line direction, as the plurality of first grooves extends from upstream to downstream in a rotational direction of the developing roller.

According to one or more other aspects of the disclosure, a developing unit may include a developing roller configured to rotate about an axis line extending in a predetermined direction, and a seal contacting an outer peripheral surface of the developing roller. The seal may include a base layer which is elastically deformable, and a surface layer contacting the outer peripheral surface of the developing roller and adhesively bonded to the base layer. The surface layer may have a slit extending in a rotational direction of the developing roller and has a plurality of grooves extending from outward to inward in the predetermined direction, as the plurality of first grooves extending from upstream to downstream in a rotational direction of the developing roller.

DETAILED DESCRIPTION

1. Overview of Developing Cartridge

Figure 1:
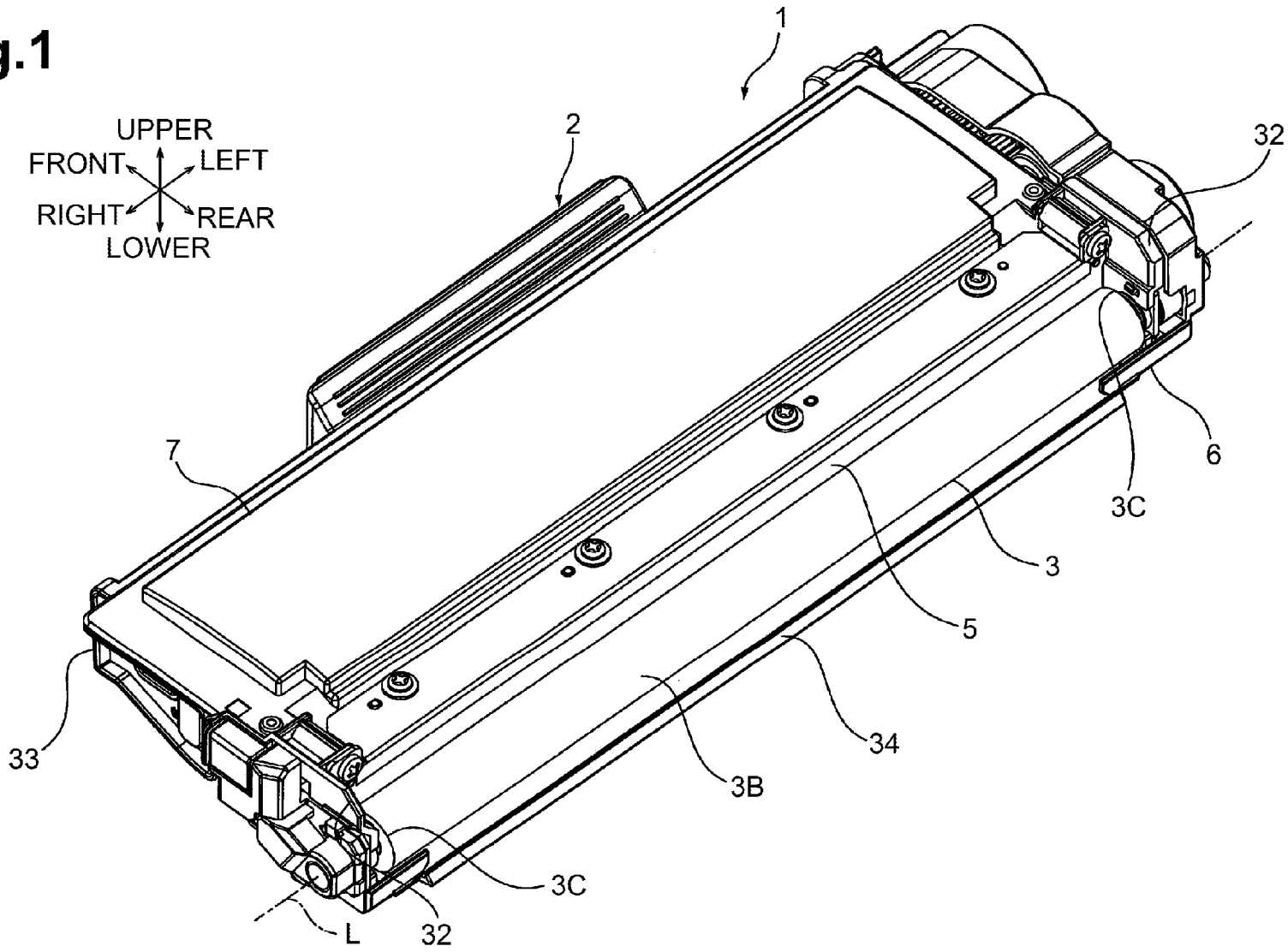
FIG. 1 is a perspective view illustrating a developing cartridge according to a first embodiment of a developing unit of the present invention.
Figure 2:
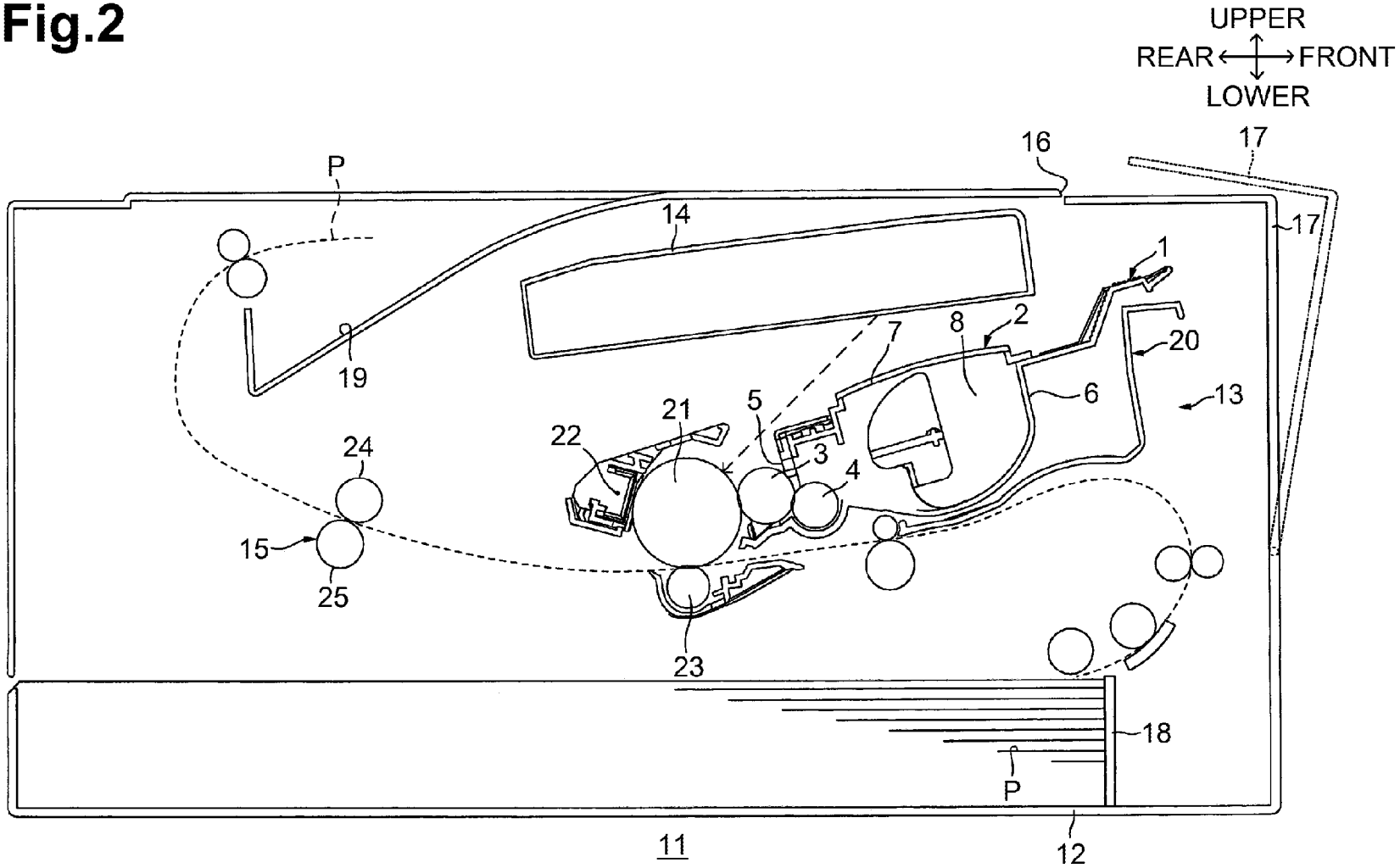
FIG. 2 is a cross-sectional view taken along the middle of an image forming apparatus in which is mounted the developing cartridge illustrated in FIG. 1.

As illustrated in FIGS. 1 and 2, a developing cartridge 1 which is an example of a developing unit includes a developing frame 2 which is an example of a housing, a developing roller 3, a supply roller 4, and a layer thickness regulating blade 5.

Note that in the following description, directions of the developing cartridge 1 will be referred to based on a state where the developing cartridge 1 is installed flat and level for the vertical direction. That is to say, in FIG. 1 the top side in the plane of the drawing is upwards, and the bottom side in the plane of the drawing is downwards. Also in FIG. 1, the upper left side in the plane of the drawing is the front, and the lower right side in the plane of the drawing is the rear. Based on the left and right when viewing the developing cartridge 1 from the front, the upper right side in the plane of the drawing is the left, and the lower left side in the plane of the drawing is the right.

The developing frame 2 has a general box shape, and includes a base frame 6 and a cover frame 7.

The base frame 6 has a general rectangular shape in plan view, and is formed as a frame having a bottom and opened upwards and to the rear.

The cover frame 7 has a plate shape, generally rectangular in plan view, and is attached to the base frame 6 so as to close the upper portion of the base frame 6.

The developing roller 3 has a general columnar shape extending in the left-right direction, and is supported at the rear end portion of the base frame 6 so as to rotatable in the counterclockwise direction in left view. More specifically, the developing roller 3 is configured so as to rotate on an axial line L which is an example of a first axial line. The axial line L extends in the left-right direction.

The supply roller 4 is situated to the lower front of the developing roller 3. The supply roller 4 has a general columnar shape extending in the left-right direction, and is supported at the rear end portion of the base frame 6 so as to rotatable in the counterclockwise direction in left view. A toner accommodation unit 8 is defined by the front of the supply roller 4, the base frame 6, and the cover frame 7.

The toner accommodation unit 8 accommodates toner within.

The layer thickness regulating blade 5 is disposed to the upper front of the developing roller 3. The layer thickness regulating blade 5 has a generally rectangular shape in frontal view. The upper edge of the layer thickness regulating blade 5 is attached to the base frame 6 and cover frame 7, and comes into contact with the front portion of the developing roller 3 at the lower edge thereof.

2. Usage Form of Developing Cartridge

The developing cartridge 1 is used by being mounted to an image forming apparatus 11, as illustrated in FIG. 2. The image forming apparatus 11 is an electrophotographic black-and-white printer. The image forming apparatus 11 includes an apparatus main unit 12, a process unit 13, a scanner unit 14, and a fixing unit 15.

The apparatus main unit 12 has a general box shape. The apparatus main unit 12 has an opening portion 16, a front cover 17, a sheet feed tray 18, and a sheet discharge tray 19.

The opening portion 16 is situated at the front of the apparatus main unit 12, and is configured such that the front wall of the apparatus main unit 12 is opened in the front-back direction, allowing passage of the process unit 13.

The front cover 17 is disposed to the front end portion of the apparatus main unit 12. The front cover 17 has a plate form, extending vertically, supported by the lower edge thereof as a pivot so was to be capable of rocking as to the front wall of the apparatus main unit 12. The front cover 17 is configured so as to open or close the opening portion 16.

The sheet feed tray 18 is disposed on the bottom within the apparatus main unit 12, and is configured to store sheets P.

The sheet discharge tray 19 is disposed on the rear half of the upper wall of the apparatus main unit 12. The sheet discharge tray 19 is recessed downwards from the upper face of the apparatus main unit 12 so as to load sheets P.

The process unit 13 is situated at the general middle of the apparatus main unit 12 in the vertical direction, and is configured to be mounted to and detached from the apparatus main unit 12. The process unit 13 includes a drum cartridge 20 and the developing cartridge 1.

The drum cartridge 20 is formed as a frame with a bottom, generally rectangular in plan view, and includes a photosensitive drum 21, a scorotron charger 22, and a transfer roller 23.

The photosensitive drum 21 is rotatably supported at the rear end of the drum cartridge 20.

The scorotron charger 22 is disposed behind the photosensitive drum 21, with spacing provided between the photosensitive drum 21 and scorotron charger 22.

The transfer roller 23 is disposed beneath the photosensitive drum 21. The transfer roller 23 comes into contact with the bottom portion of the photosensitive drum 21.

The developing cartridge 1 is detachably mounted to the drum cartridge 20 such that the developing roller 3 comes into contact with the front portion of the photosensitive drum 21.

The scanner unit 14 is disposed above the process unit 13. The scanner unit 14 is configured to emit a laser beam toward the photosensitive drum 21.

The fixing unit 15 is disposed behind the process unit 13. The fixing unit 15 includes a heating roller 24, and a pressure roller 25 which is pressed against the lower rear portion of the heating roller 24.

Upon the image forming apparatus 11 starting image forming operations, the scorotron charger 22 uniformly charges the surface of the photosensitive drum 21. The scanner unit 14 exposes the surface of the photosensitive drum 21, based on image data. Thus, an electrostatic latent image based on the image data is formed on the surface of the photosensitive drum 21.

The supply roller 4 supplies the toner in the toner accommodation unit 8 to the developing roller 3. At this time, the toner is charged by friction to a positive polarity between the developing roller 3 and the supply roller 4, and is carried by the developing roller 3. The layer thickness regulating blade 5 regulates the thickness of the toner layer carried on the developing roller 3 to a constant thickness.

The toner carried by the developing roller 3 is then supplied to the electrostatic latent image on the surface of the photosensitive drum 21. Accordingly, a toner image is carried on the surface of the photosensitive drum 21.

Sheets P are fed one at a time from the sheet feed tray 18, at predetermined timings, by rotation of various rollers, and fed to the nip of the photosensitive drum 21 and transfer roller 23. The toner image on the photosensitive drum 21 is transferred to the sheet P when passing between the photosensitive drum 21 and the transfer roller 23.

Thereafter, the sheet P is heated and pressurized when passing between the heating roller 24 and the pressure roller 25. The toner image on the sheet P is thermally fixed to the sheet P at this time. Thereafter, the sheet P is discharged to the sheet discharge tray 19.

3. Detailed Description of Developing Cartridge

Figure 3:
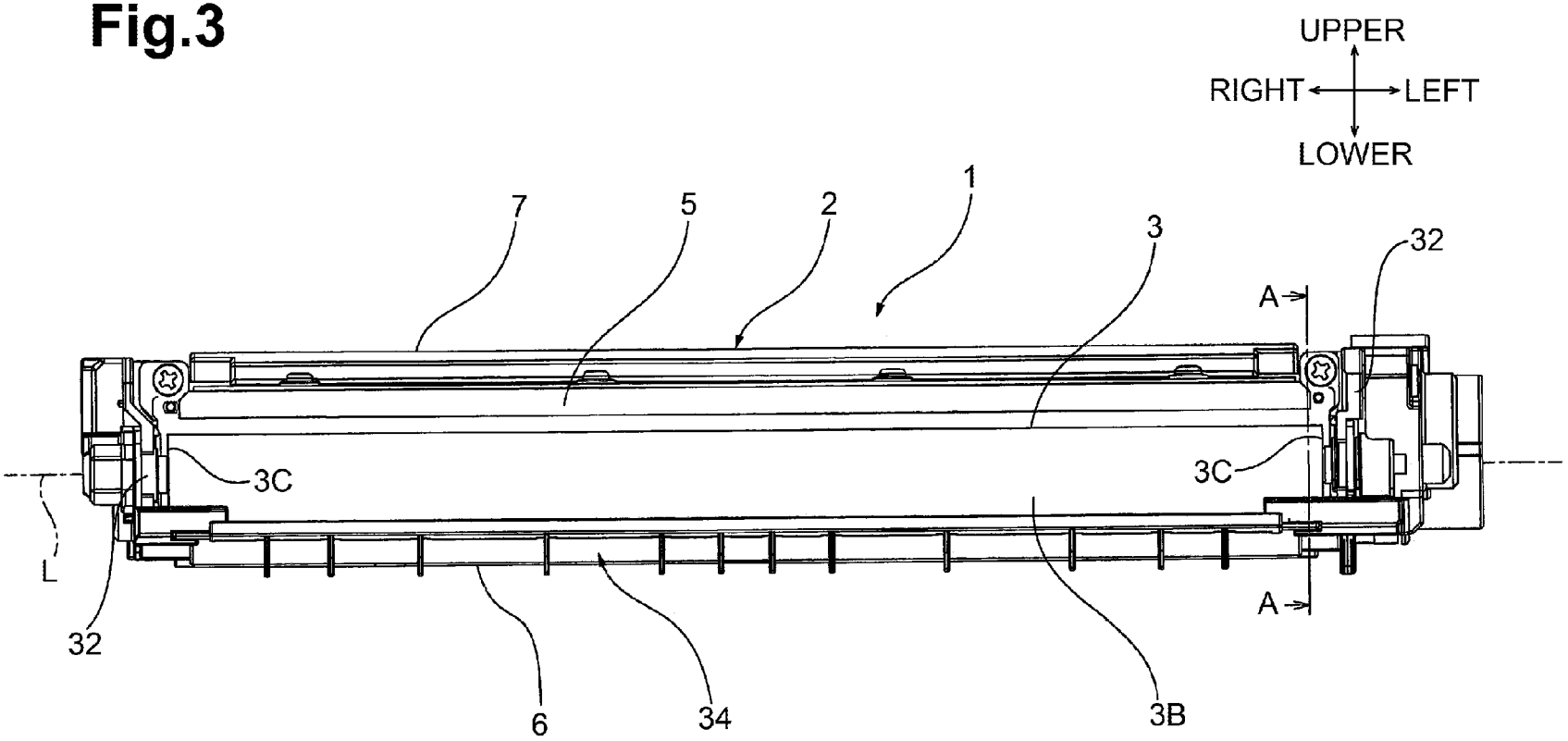
FIG. 3 is a rear view of the developing cartridge illustrated in FIG. 1.
Figure 4:
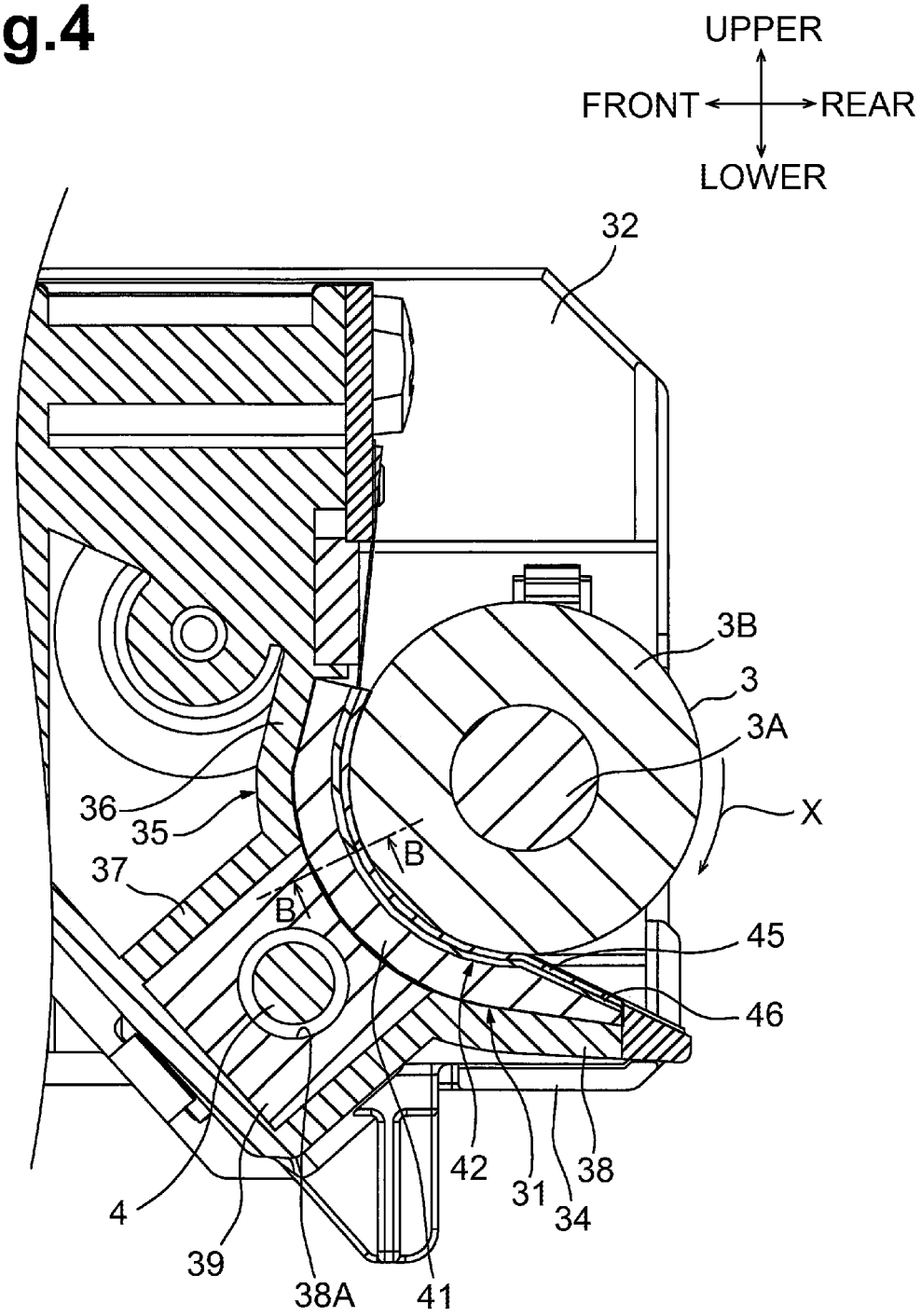
FIG. 4 is a cross-sectional view of the developing cartridge taken along A-A in FIG. 3.
Figure 5:
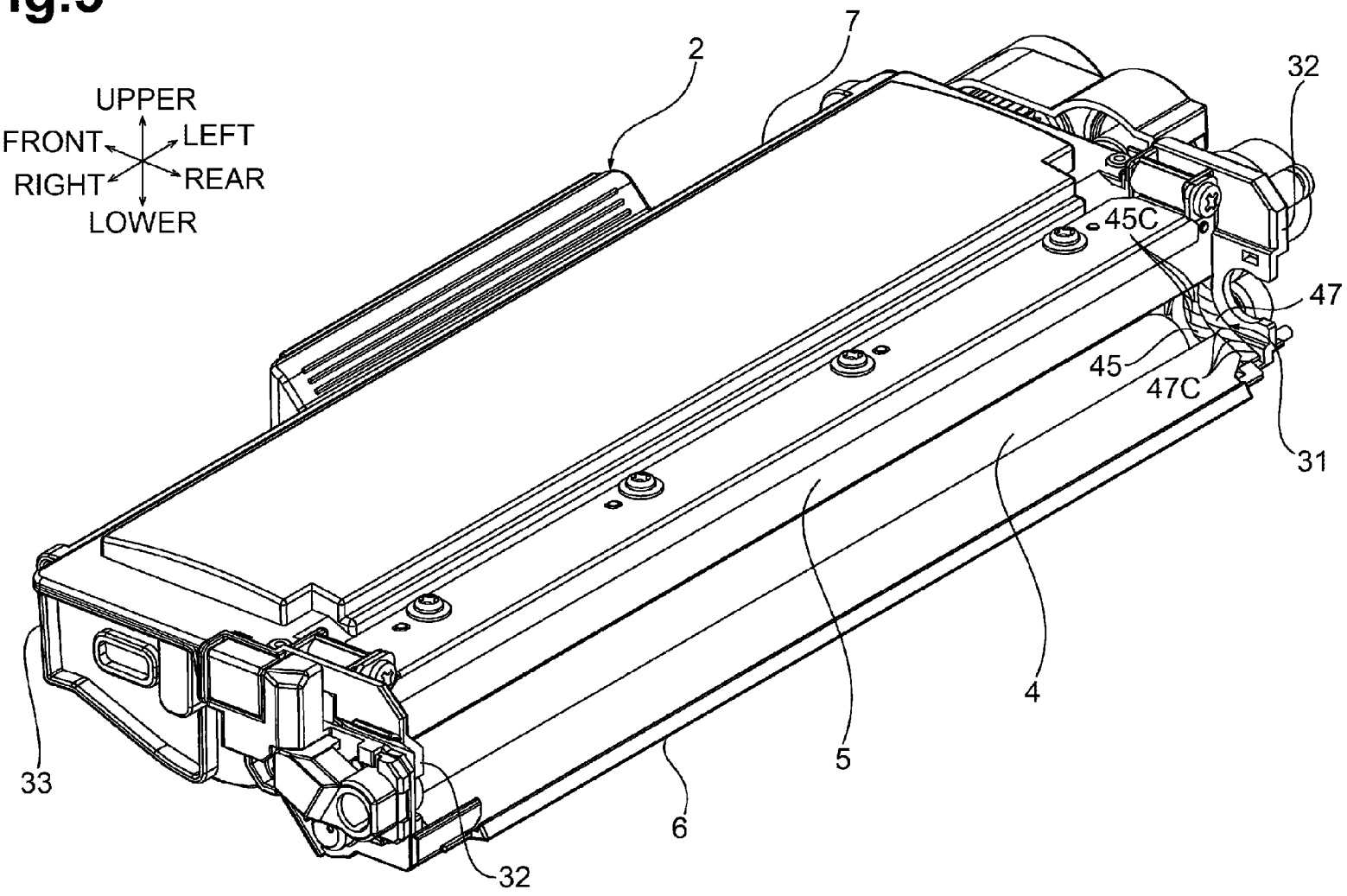
FIG. 5 is a perspective view illustrating a state in which a developing roller has been removed from the developing cartridge illustrated in FIG. 1.

The developing cartridge 1 includes the developing frame 2 described above, the developing roller 3 described above, and a pair of side seals 31 which is an example of a seal member, as illustrated in FIGS. 1, 3, and 4.

(1) Developing Frame

The base frame 6 of the developing frame 2 integrally includes a pair of side walls 32, a front wall 33, and a lower wall 34.

Each of the side walls 32 has a plate shape, generally rectangular in side view, and extends in the front-back direction. The pair of side walls 32 is disposed with space between the two in the left-right direction. Each of the pair of side walls 32 has a side seal supporting portion 35, as illustrated in FIG. 4.

The side seal supporting portions 35 are situated at the rear edge portions of each of the pair of side walls 32. The side seal supporting portions 35 protrude inward in the left-right direction from each of the pair of side walls 32, and each has an upper supporting portion 36, a recessed portion 37, and a lower supporting portion 38.

The upper supporting portion 36 is positioned somewhat lower than the middle at the lower edge portion of each of the side walls 32. The upper supporting portion 36 has a general arc shape in side view, and has a general plate shape extending vertically. The upper supporting portion 36 is slightly curved forwards in side view.

The recessed portion 37 is situated beneath the upper supporting portion 36. The upper rear of the recessed portion 37 is opened, and an opened box form recessed downwards in side view is formed. The upper edge of the recessed portion 37 is continuous with the lower edge of the upper supporting portion 36. The recessed portion 37 supports a shaft seal 39.

The shaft seal 39 is situated where the recessed portion 37 is recessed. The shaft seal 39 has a general square post shape, and is formed of an elastic material such as sponge, with the rear upper face curving toward the lower front. The shaft seal 39 has a through hole 38A. The through hole 38A penetrates the shaft seal 39 in the left-right direction, and the shaft of the supply roller 4 is passed through the through hole 38A.

The lower supporting portion 38 is positioned behind the recessed portion 37. The lower supporting portion 38 has a general plate shape, rectangular in plan view. The lower supporting portion 38 is inclined somewhat downwards from the front toward the rear in side view. The front edge of the lower supporting portion 38 is continuous with the rear edge of the recessed portion 37.

The rear face of the upper supporting portion 36, the upper rear face of the shaft seal 39, and the upper face of the lower supporting portion 38, are flush, curving toward the back from the top toward the bottom, and making up the upper rear face of the side seal supporting portion 35.

(2) Developing Roller

The developing roller 3 includes a developing roller shaft 3A and a developing roller main unit 3B.

The developing roller shaft 3A is formed of metal and has a general columnar shape, extending in the left-right direction. The left and right ends of the developing roller shaft 3A are rotatably supported by the pair of side walls 32 so that the developing roller 3 is rotatable in the clockwise direction in right view, which is in a rotational direction X.

The developing roller main unit 3B is formed of a rubber having electroconductivity, and has a general cylinder shape extending in the left-right direction. The developing roller main unit 3B does not cover the left and right ends of the developing roller shaft 3A but rather covers the general middle of the developing roller shaft 3A in the left-right direction. The ends of the developing roller main unit 3B are developing roller edges 3C which are an example of outer edges.

(3) Side Seals

Each of the pair of side seals 31 is disposed on the upper rear face of the respective side seal supporting portions 35 of the pair of side walls 32. Each of the pair of side seals 31 has a general plate shape, generally arc-shaped in side view and generally rectangular in plan view. Each side seal 31 has a base material 41, a first upper layer portion 42 which is an example of a first part, and a second upper layer portion 43 which is an example of a second part.

(3-1) Base Material

Figure 6A:
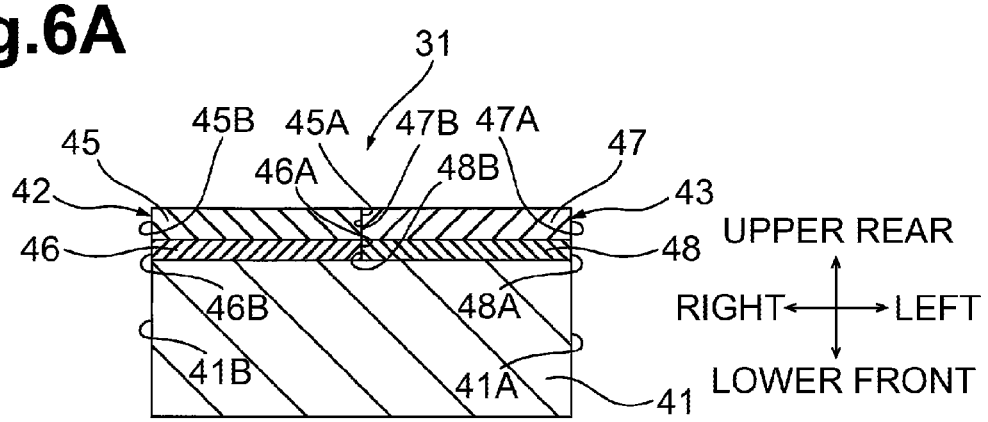
FIG. 6A is a cross-sectional view of a side seal illustrated in FIG. 4, taken along B-B in FIG. 4.
Figure 6B:
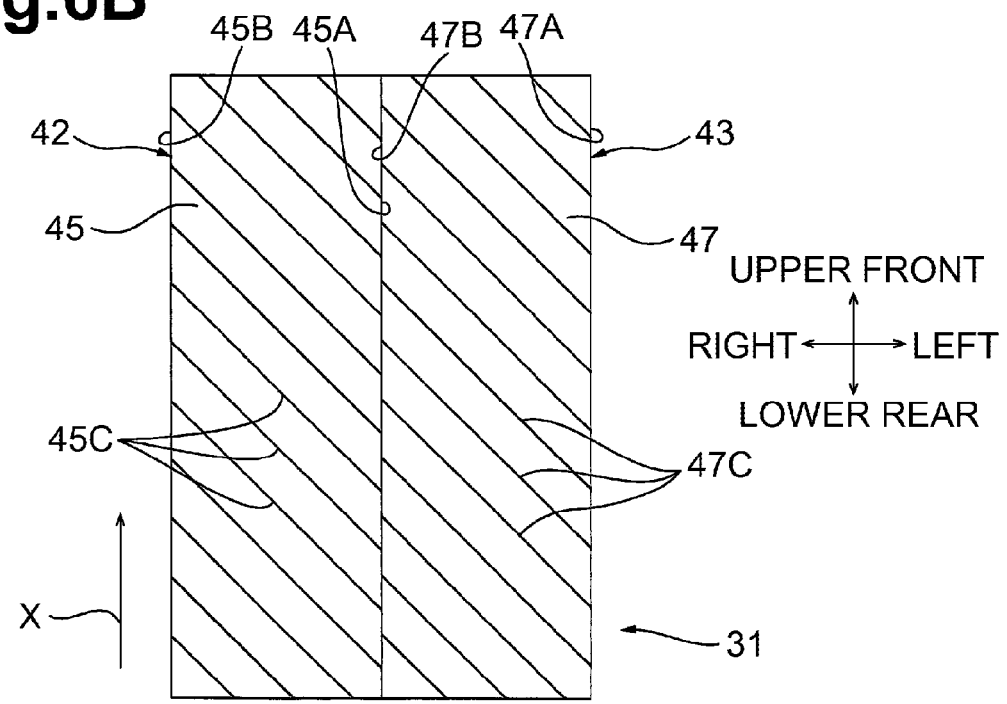
FIG. 6B is a diagram illustrating the side seal in FIG. 4 from the upper rear.

The base material 41 is generally arc-shaped in side view and generally rectangular in plan view, and is in the form of a plate having a certain thickness, as illustrated in FIGS. 4, 6A, and 6B. More specifically, the base material 41 is curved so as to extend toward the rear in the downward direction, in side view. The base material 41 is formed of a resin sponge such as urethane resin or the like, silicone rubber, or an elastomer such as natural rubber. The outer side edge of the base material 41 in the left-right direction is a base material outer edge 41A, and the inner side edge of the base material 41 is a base material inner edge 41B. The base material 41 is in contact with the upper rear face of the side seal supporting portion 35. More specifically, the base material 41 is in close contact with the rear face of the upper supporting portion 36, the upper rear face of the shaft seal 39, and the upper face of the lower supporting portion 38. The base material 41 on the opposite side of the developing roller 3 from the later-described first upper layer portion 42 and second upper layer portion 43 in the thickness direction thereof.

(3-2) First Upper Layer Portion

The first upper layer portion 42 has a general plate shape, generally arc-shaped in side view and generally rectangular in plan view, and includes a first seal layer 45 which is an example of a first surface layer, and a first adhesive layer 46. The first upper layer portion 42 is thinner than the base material 41. The first upper layer portion 42 is situated between the inward portion in the left-right direction of the base material 41 and the developing roller 3, in the thickness direction thereof.

(3-2-1) First Seal Layer

The first seal layer 45 is generally arc-shaped in side view and generally rectangular in plan view, and is in the form of a plate having a certain thickness. More specifically, the first seal layer 45 is curved so as to extend toward the rear in the downward direction, in side view. The width of the first seal layer 45 is approximately half that of the base material 41. The first seal layer 45 is formed of non-woven cloth, a fiber material such as a cashmere, or a woven article of polytetrafluoroethylene fiber or a polyester fiber or the like. The first seal layer 45 is situated at the upper rear side of the base material 41 with the later-described first adhesive layer 46 interposed therebetween. More specifically, the first seal layer 45 is situated at the upper rear of the inward portion in the left-right direction of the base material 41. The outer side edge of the first seal layer 45 in the left-right direction is a first seal outer edge 45A which is an example of an outer edge face, and the inner side face of the first seal layer 45 is a first seal inner edge 45B. The first seal layer 45 is situated on the developing roller 3 side in the thickness direction thereof, and is in sliding contact with the developing roller main unit 3B of the developing roller 3. The first seal layer 45 has multiple first grooves 45C.

The multiple first grooves 45C are each formed on the upper rear face of the first seal layer 45, i.e., on the surface of the first seal layer 45. Each of the multiple first grooves 45C extends from outward to inward in the right-left direction heading in the upward direction, with equal spacing therebetween. That is to say, each of the multiple first grooves 45C extends outward to inward in the right-left direction, from upstream to downstream in a rotational direction of the developing roller 3.

(3-2-2) First Adhesive Layer

The first adhesive layer 46 is generally arc-shaped in side view and generally rectangular in plan view, having a certain thickness. More specifically, the first adhesive layer 46 is curved so as to extend toward the rear in the downward direction, in side view. The first adhesive layer 46 is situated between the base material 41 and the first seal layer 45 in the thickness direction thereof. The first adhesive layer 46 is formed of an adhesive material, so as to adhere the upper rear face of the base material 41 and the front lower face of the first seal layer 45 to each other. Examples usable for the first adhesive layer 46 include two-sided tape, a fast-drying cyanoacrylic or like adhesive agent, and so forth. The outer side edge of the first adhesive layer 46 in the left-right direction is a first adhesive outer edge 46A which is an example of an outer edge, and the inner side edge of the first adhesive layer 46 is a first adhesive inner edge 46B which is an example of an inner edge. The first adhesive outer edge 46A is continuous with the first seal outer edge 45A, and the first adhesive inner edge 46B is continuous with the first seal inner edge 45B and base material inner edge 41B, in a direction orthogonal to the left-right direction, i.e., in a direction orthogonal to the axial line direction of the developing roller 3.

(3-3) Second Upper Layer Portion

The second upper layer portion 43 is generally arc-shaped in side view and generally rectangular in plan view, is in the form of a plate having a certain thickness, and has a second seal layer 47 which is an example of a second surface layer, and a second adhesive layer 48. The second upper layer portion 43 is thinner than the base material 41. The second upper layer portion 43 is situated between the outward portion in the left-right direction of the base material 41 and the developing roller 3, in the thickness direction thereof.

(3-3-1) Second Seal Layer

The second seal layer 47 is generally arc-shaped in side view and generally rectangular in plan view, and is in the form of a plate having a certain thickness. More specifically, the second seal layer 47 is curved so as to extend toward the rear in the downward direction, in side view. The width of the second seal layer 47 is approximately half that of the base material 41. The second seal layer 47 is formed of non-woven cloth, a fiber material such as a cashmere, or a woven article of polytetrafluoroethylene fiber or a polyester fiber or the like. The second seal layer 47 is situated at the upper rear side of the base material 41 with the second adhesive layer 48, which will be described later, interposed therebetween. More specifically, the second seal layer 47 is situated at the upper rear of the outer portion in the left-right direction of the base material 41. That is to say, the second seal layer 47 is situated outward from the first seal layer 45 in the left-right direction.

The outer side edge of the second seal layer 47 in the left-right direction is a second seal outer edge 47A, and the inner side edge of the second seal layer 47 is a second seal inner edge 47B. The second seal outer edge 47A is an example of an outer edge, and the second seal inner edge 47B is an example of an inner edge. The second seal outer edge 47A is situated on the developing roller 3 side in the thickness direction thereof, and is in sliding contact with the developing roller main unit 3B of the developing roller 3. The second seal inner edge 47B of the second seal layer 47 is in contact with the first seal outer edge 45A of the first seal layer 45 in the left-right direction. The second seal layer 47 has multiple second grooves 47C.

The multiple second grooves 47C are each formed on the upper rear face of the second seal layer 47, i.e., on the surface of the second seal layer 47. Each of the multiple second grooves 47C extends from outward to inward in the right-left direction heading in the upward direction, with equal spacing therebetween. That is to say, each of the multiple second grooves 47C extends outward to inward in the right-left direction, from upstream to downstream in the rotational direction of the developing roller 3.

(3-3-2) Second Adhesive Layer

The second adhesive layer 48 is generally arc-shaped in side view and generally rectangular in plan view. More specifically, the second adhesive layer 48 is curved so as to extend toward the rear in the downward direction, in side view. The second adhesive layer 48 is situated between the base material 41 and the second seal layer 47 in the thickness direction thereof. The second adhesive layer 48 is formed of an adhesive material, so as to adhere the upper rear face of the base material 41 and the front lower face of the second seal layer 47 to each other. Examples usable for the second adhesive layer 48 include two-sided tape, a fast-drying cyanoacrylic or like adhesive agent, and so forth. The outer side edge of the second adhesive layer 48 in the left-right direction is a second adhesive outer edge 48A which is an example of an outer edge, and the inner side edge of the second adhesive layer 48 is a second adhesive inner edge 48B which is an example of an inner edge. The second adhesive outer edge 48A is continuous with the second seal outer edge 47A and base material outer edge 41A, and the second adhesive inner edge 48B is continuous with the second seal inner edge 47B.

4. First Groove and Second Groove

As described earlier, the multiple first grooves 45C and the multiple second grooves 47C at the first seal layer 45 and second seal layer 47 are formed with an inclination as to the rotational direction X of the developing roller 3, so as to be able to return toner, intruding between the side seal 31 and developing roller 3, to the toner accommodation unit 8. This is formed as follows.

Figure 7:
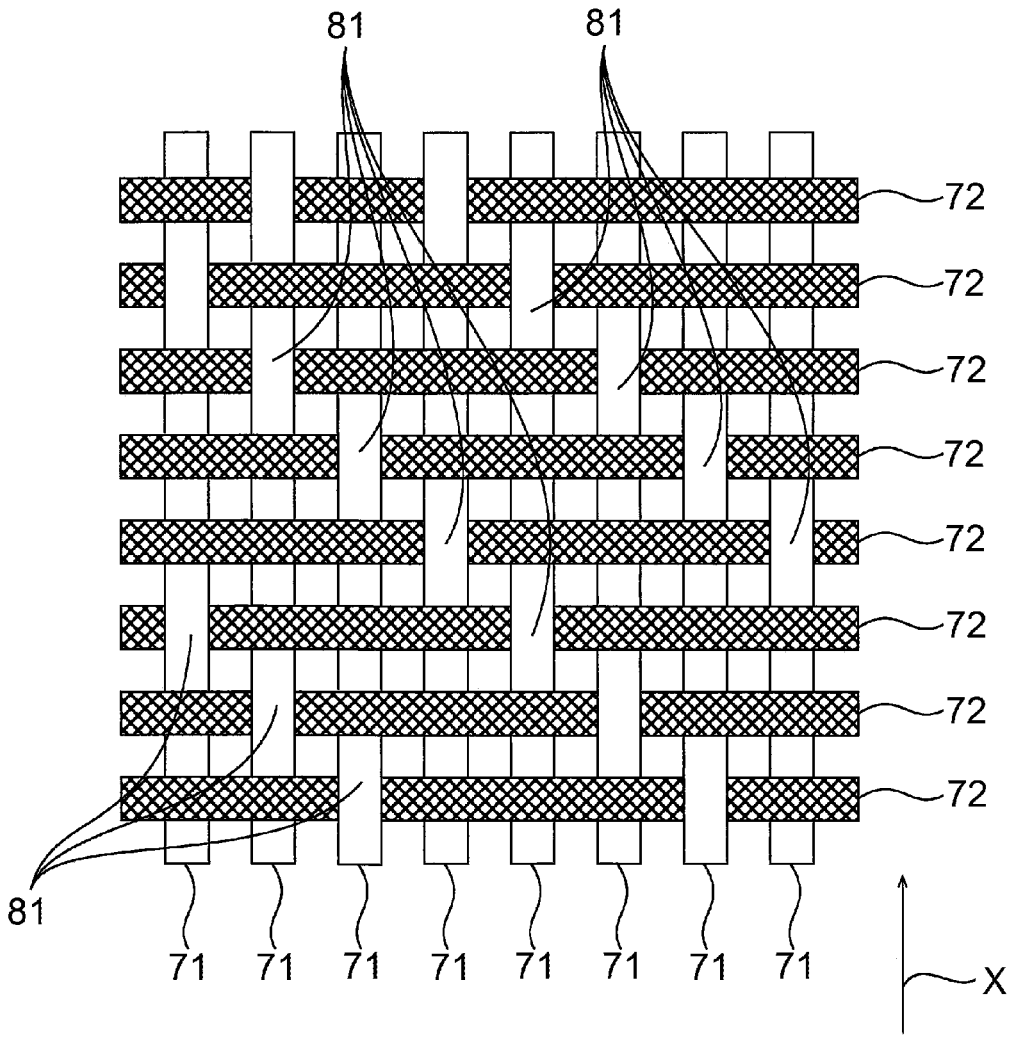
FIG. 7 is a detailed schematic diagram of the side seal in FIG. 4.

As illustrated in FIG. 7, the first seal layer 45 and second seal layer 47 are woven such that the crosses of the warp and weft form an oblique pattern. That is to say, one warp end 71 crosses one weft 72 and then goes under three wefts 72. On the other hand, one weft 72 goes over three warp ends 71, and then goes under one warp end 71. Three consecutive warp ends 71 go under one common weft 72, following which at the next weft 72, one warp end 71 at the edge goes over this weft 72 while the other two warp ends 71 continue under this weft 72. At the side which slides against the developing roller 3, the warp ends 71 which cross over the weft 72, which will be referred to as front-side warp ends 81, protrude toward out from the face which slides against the developing roller 3. The front-side warp ends 81 are arranged to appear in an oblique pattern, and it is by a continuous array of the front-side warp ends 81 that the multiple first grooves 45C and multiple second grooves 47C are formed on the surface of the first seal layer 45 and second seal layer 47.

The side seals 31 are formed such that the multiple first grooves 45C and multiple second grooves 47C formed by the front-side warp ends 81 of the first seal layer 45 and second seal layer 47 are formed in an inclined manner, facing the downstream toner accommodation unit 8 from the upstream developing roller 3 in the rotational direction X. Specifically, the multiple first grooves 45C and multiple second grooves 47C are formed such that the angle of inclination as to the rotational direction X of the developing roller 3 is 45 degrees or smaller.

5. Contact of Developing Roller and Side Seal

In a state in which the developing roller 3 and side seal 31 are in contact, the developing roller 3 and side seal 31 are in a predetermined relation, as illustrated in FIGS. 6A and 6B. More specifically, the developing roller edge 3C of the developing roller 3 is situated inward as compared to the edge of the second seal outer edge 47A of the second seal layer 47 in the left-right direction. Further, the developing roller edge 3C of the developing roller 3 is situated outward of the first seal outer edge 45A of the first seal layer 45 and the second seal inner edge 47B of the second seal layer 47. That is to say, the second seal outer edge 47A of the second seal layer 47 is situated outward from the developing roller edge 3C of the developing roller 3 in the left-right direction. Also, the second seal inner edge 47B of the second seal layer 47 is situated inward from the developing roller edge 3C of the developing roller 3.

6. Rotation Operations of Developing Roller

When the developing roller 3 rotates in the rotational direction X during image forming operations described above, the fluid toner enters between the left edge of the developing roller 3 and the first seal layer 45. However, the toner which has found its way into between the left edge of the developing roller 3 and the first seal layer 45 moves inward in the left-right direction being guided by the first grooves 45C along with rotation of the developing roller 3, and is returned to the toner accommodation unit 8 of the developing cartridge 1.

When toner which has found its way into between the left edge of the developing roller 3 and the first seal layer 45 is not returned to the toner accommodation unit 8 but further moves outward in the left-right direction, the toner enters between the left edge of the developing roller 3 and the second seal layer 47. The toner which has found its way into between the left edge of the developing roller 3 and the second seal layer 47 moves inward in the left-right direction being guided by the second grooves 47C along with rotation of the developing roller 3, and is returned between the left edge of the developing roller 3 and the first seal layer 45. This toner between the left edge of the developing roller 3 and the first seal layer 45 then moves inward in the left-right direction being guided by the first grooves 45C along with rotation of the developing roller 3, and is returned to the toner accommodation unit 8 of the developing cartridge 1.

7. Contact of Side Seal to Developing Roller Under Impact to Developer Cartridge As described above, the first upper layer portion 42 having the first seal layer 45 is configured as a separate material from the second upper layer portion 43 having the second seal layer 47. The first seal layer 45 and second seal layer 47 come into contact with the developing roller main unit 3B of the developing roller 3. Accordingly, in a case where the developing cartridge 1 is subjected to impact, the first upper layer portion 42 and second upper layer portion 43 vibrate separately. The base material 41 is suitably elastically deformable in the direction orthogonal to the axial direction of the developing roller 3, i.e., in the lower front direction, upon having received pressing force from the developing roller 3.

8. Advantages (1) According to this developing cartridge 1, multiple first grooves 45C extend from outward to inward, from upstream to downstream in the rotational direction of the developing roller 3, as illustrated in FIG. 6B.

Accordingly, even if toner which the developing roller 3 is carrying finds its way between the developing roller 3 and the first seal layer 45, the toner moves inward in the left-right direction being guided by the multiple first grooves 45C along with rotation of the developing roller 3, and can be returned to the toner accommodation unit 8.

Also, the side seals 31 have a first upper layer portion 42 situated inward in the left-right direction, and a second upper layer portion 43 in contact with the outer edge of the first upper layer portion 42 and situated outward from the first upper layer portion 42 in the left-right direction.

Accordingly, under impact to the developing cartridge 1, the first upper layer portion 42 and second upper layer portion 43 vibrate separately. That is to say, at least one of the first upper layer portion 42 and the second upper layer portion 43 maintain state of contact with the surface of the developing roller 3.

Consequently, even if a gap forms between the first seal layer 45 and developing roller 3, the second seal layer 47 is in contact with the developing roller 3, so leakage of toner carried by the developing roller 3 from the developing cartridge 1 can be suppressed. Also, even if a gap forms between the second seal layer 47 and developing roller 3, the first seal layer 45 is in contact with the developing roller 3, so leakage of toner carried by the developing roller 3 from the developing cartridge 1 can be suppressed.

Thus, leakage of toner from the developing cartridge 1 can be suppressed in a sure manner.

(2) Also, according to the developing cartridge 1, the edge of the second seal outer edge 47A is situated outward of the developing roller edge 3C of the developing roller 3 in the left-right direction, and the edge of the second seal inner edge 47B is situated inward from the developing roller edge 3C of the developing roller 3, as illustrated in FIG. 6B.

Accordingly, the first seal layer 45 situated inward from the second seal layer 47 in the left-right direction can be brought into contact with the developing roller 3 in a sure manner.

Consequently, the first seal layer 45 can be strongly pressed by the developing roller 3.

Thus, formation of a gap between the first seal layer 45 and the developing roller 3 can be suppressed.

Also, pressing the first seal layer 45 stronger than the second seal layer 47 means that when impact is applied to the developing cartridge 1, the second seal layer 47 is more readily situated at the surface side of the developing roller 3 as compared to the first seal layer 45.

This creates a small step between the first seal layer 45 and the second seal layer 47.

As a result, the step between the first seal layer 45 and the second seal layer 47 suppresses leakage of toner from the developing cartridge 1 along the multiple first grooves 45C and multiple second grooves 47C.

(3) Also, according to the developing cartridge 1, the multiple second grooves 47C of the second seal layer 47 extend outward to inward in the left-right direction, from upstream to downstream in the rotational direction of the developing roller 3, as illustrated in FIG. 6B.

Accordingly, even if toner carried by the developing roller 3 finds its way into between the developing roller 3 and the second seal layer 47, the toner can be guided inward in the left-right direction by the multiple second grooves 47C, by rotation of the developing roller 3.

Also, the outer edges of the multiple first grooves 45C in the left-right direction are positioned at different positions from the inner edges of the multiple second grooves 47C in the left-right direction, so as to be mutually offset in the rotational direction of the developing roller 3.

Accordingly, the overall length of groves over which the toner moves when moving over the first grooves 45C and second grooves 47C can be made longer. Specifically, in a case where toner which has found its way in between the left edge of the developing roller 3 and the first seal layer 45 moves to the second seal outer edge 47A of the second seal layer 47, the toner moves from the inner side of the first grooves 45C to the outer side, further moves at the boundary between the first seal layer 45 and second seal layer 47 along with the rotations of the developing roller 3, and moves to the inner edge of the second grooves 47C in the left-right direction. Toner which has found its way in between the left edge of the developing roller 3 and the second seal layer 47 moves over the second grooves 47C from the inner side to the outer side in the left-right direction. This adds the length from the outer edge of the first grooves 45C in the left-right direction to the inner edge of the second grooves 47C left-right direction, to the length of the first grooves 45C and second grooves 47C. Accordingly, the distance over which the toner has to travel before leaking out from the developing cartridge 1 can be extended.

As a result, leakage of toner carried by the developing roller 3 from the developing cartridge 1 can be even further suppressed.

(4) Also, according to the developing cartridge 1, the first upper layer portion 42 and second upper layer portion 43 are configured as separate members, as illustrated in FIG. 6A.

Accordingly, the first upper layer portion 42 and second upper layer portion 43 can be made to vibrate separately in a sure manner when the developing cartridge 1 is subjected to impact.

Consequently, formation of gaps between the developing roller 3 and the first seal layer 45 of the first upper layer portion 42, and between the developing roller 3 and the second seal layer 47 of the second upper layer portion 43, can be suppressed even further.

(5) Also, according to the developing cartridge 1, the first upper layer portion 42 is situated between the inward portion of the base material 41 in the left-right direction and the developing roller 3, in the thickness direction, and the second seal layer 47 is situated between the outer portion of the base material 41 in the left-right direction and the developing roller 3, in the thickness direction, as illustrated in FIG. 6A.

Accordingly, the overall side seal 31 can be suitably elastically deformed by the base material 41 while appropriately forming the first grooves 45C out of the first seal layer 45 of the first upper layer portion 42, and appropriately forming the second grooves 47C out of the second seal layer 47 of the second upper layer portion 43.

(6) Also, according to the developing cartridge 1, the first upper layer portion 42 has a first adhesive layer 46 situated between the first seal layer 45 and the base material 41, and the second upper layer portion 43 has a second adhesive layer 48 situated between the second seal layer 47 and the base material 41, as illustrated in FIG. 6A.

Accordingly, the first seal layer 45 and base material 41 can be adhered in a sure manner by the first adhesive layer 46, and the second seal layer 47 and base material 41 can be adhered in a sure manner by the second adhesive layer 48, so as to realize separate vibration of the first upper layer portion 42 and second upper layer portion 43 in a sure manner.

9. Modifications

Modifications of the developing cartridge will be described with reference to FIGS. 8A through 12B. Note that in the following modifications, part which are the same as in the first embodiment are denoted with the same reference numerals, and description thereof will be omitted.

(1) Developing Cartridge According to Second Embodiment

The first upper layer portion 42 and second upper layer portion 43 have been described as being configured as separate members in the above-described first embodiment.

Figure 8A:
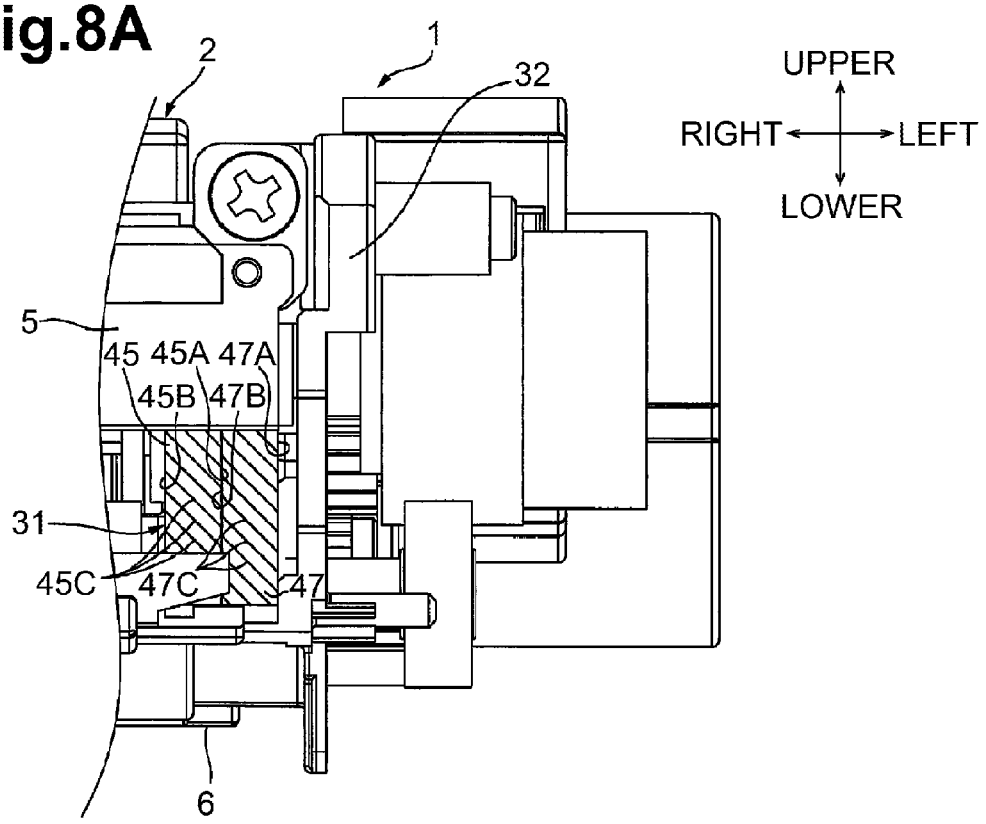
FIG. 8A is a rear view illustrating a left end portion in a state in which the developing roller has been removed from the developing cartridge illustrated in FIG. 1.
Figure 8B:
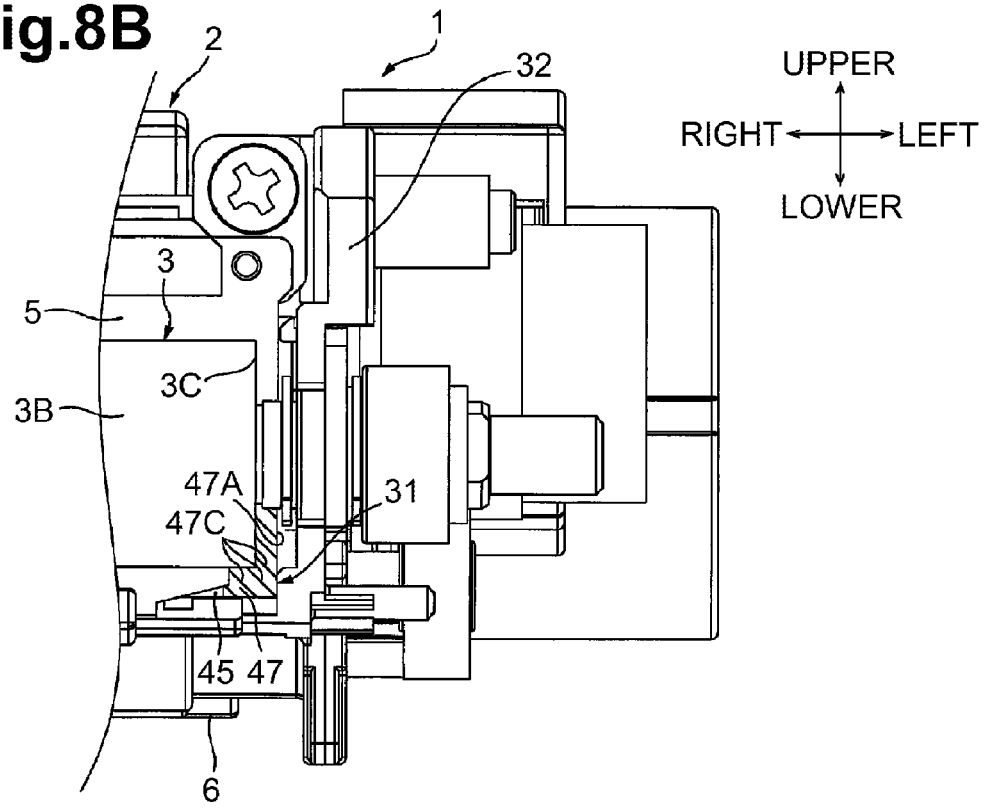
FIG. 8B is a rear view of the left portion of the developing cartridge illustrated in FIG. 1.

Conversely, according to a second embodiment the first seal layer 45 and the second seal layer 47 are formed of the same material, as illustrated in FIGS. 8A and 8B. That is to say, the first seal layer 45 and the second seal layer 47 are formed integrally as a seal layer 50. The first adhesive layer 46 and second adhesive layer 48 are also formed integrally as an adhesive layer 51. Multiple grooves are formed on the surface of the seal layer 50. The multiple grooves are formed at equal intervals, and extend outward to inward from the lower rear toward the upper front.

Figure 9A:
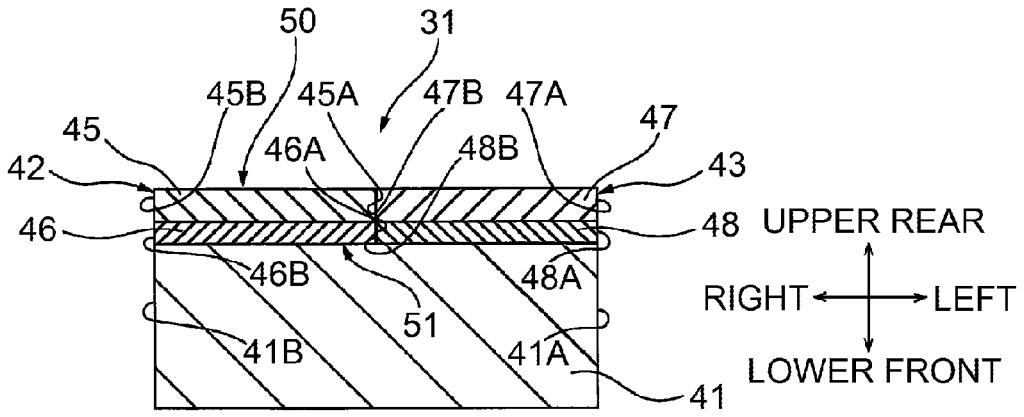
FIG. 9A is a cross-sectional view of a side seal according to a second embodiment of the developing cartridge illustrated in FIG. 1.
Figure 9B:
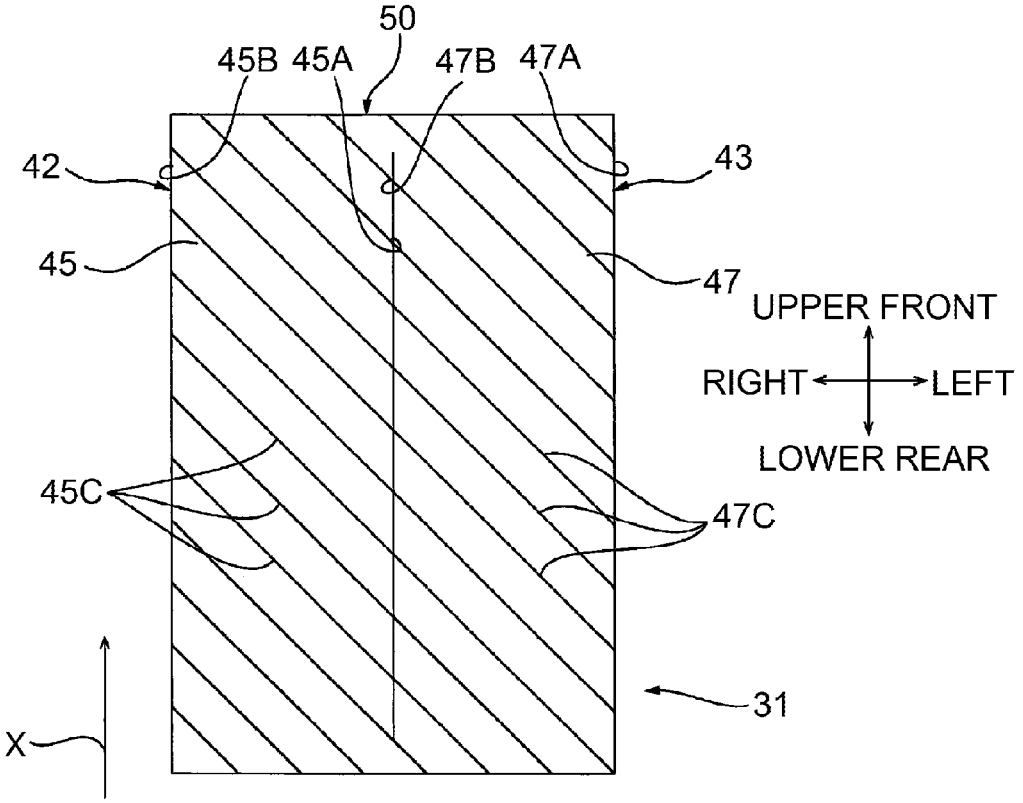
FIG. 9B is an upper rear view of the side seal according to the second embodiment of the developing cartridge illustrated in FIG. 1.

The side seal 31 has a slit, as illustrated in FIGS. 9A and 9B. The slit is formed at the left-right direction middle of the surface of the seal layer 50, and extends in the direction of rotation of the developing roller 3. In a state viewed from the upper rear, the slit is formed partway from the upper edge to the lower edge of the seal layer 50, which is to say the slit does not reach all the way to the upper front edge or lower rear edge of the seal layer 50. The length of the slit in the direction of rotation of the developing roller 3 is equal to the length of the portion of the seal layer 50 which is in contact with the peripheral face of the developing roller 3. The slit is cut to a depth of the lower edge of the adhesive layer 51 from the surface of the seal layer 50.

Accordingly, the inward portion in the left-right direction of the seal layer 50 from the slit is formed as the first upper layer portion 42, and the outward portion in the left-right direction of the seal layer 50 is formed as the second upper layer portion 43. Also, multiple groove portions at the inward portion of the seal layer 50 in the left-right direction the slit are formed as the first grooves 45C, and multiple groove portions at the outward portion of the seal layer 50 in the left-right direction from the slit are formed as the second grooves 47C. Further, the inward portion of the adhesive layer 51 in the left-right direction from the slit is formed as the first adhesive layer 46, and the outward portion of the adhesive layer 51 in the left-right direction from the slit is formed as the second adhesive layer 48.

Thus, according to the developing cartridge 1 of the second embodiment, the first seal layer 45 and second seal layer 47 are integrally formed, and the first adhesive layer 46 and second adhesive layer 48 are integrally formed.

The configuration of the side seal 31 is thus made simple.

The path over which the toner travels, moving over the multiple first grooves 45C and multiple second grooves 47C, can be made straight.

Accordingly, toner which has entered in between the second seal layer 47 and the developing roller 3 can be returned to inside the developing cartridge 1 more easily.

(2) Developing Cartridge According to Third Embodiment

The base material 41 has been described in the above-described first embodiment as being generally arc-shaped in side view and generally rectangular in plan view, and having the form of a plate having a certain thickness.

Figure 10A:
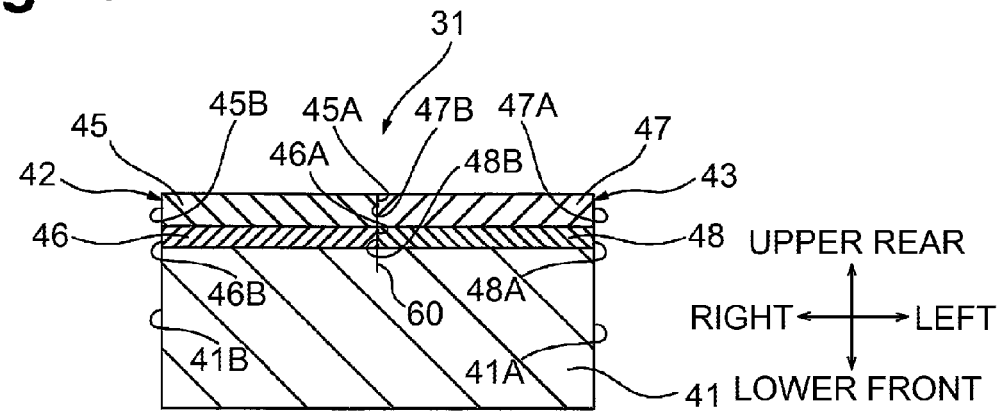
FIG. 10A is a cross-sectional view of a side seal according to a third embodiment of the developing cartridge illustrated in FIG. 1.
Figure 10B:
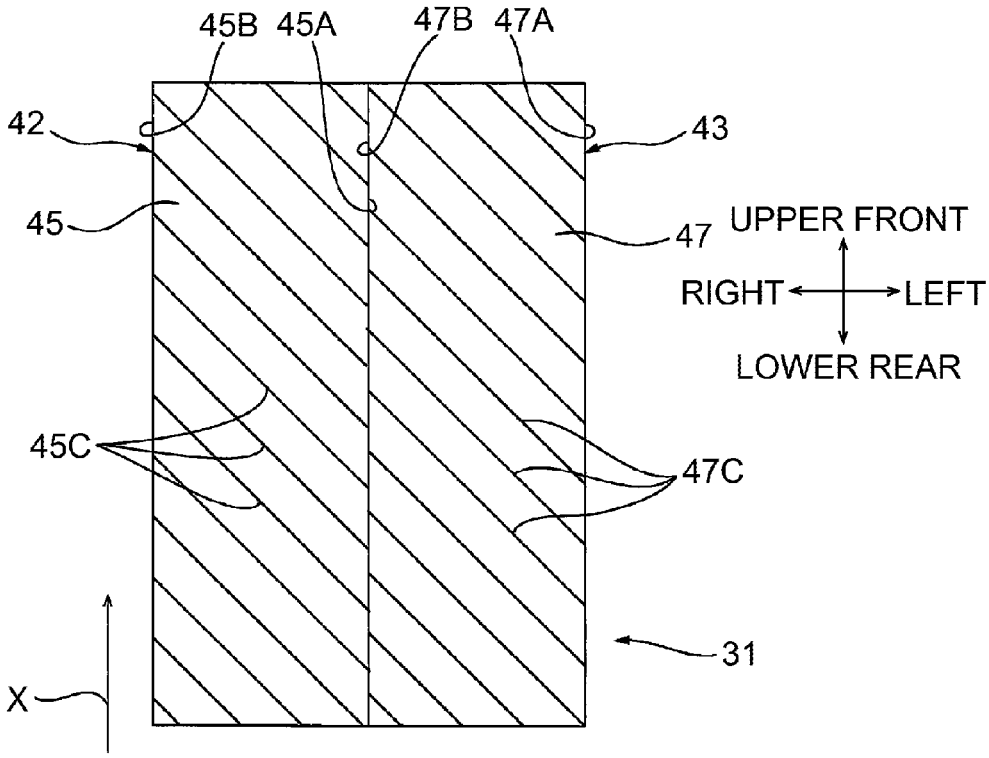
FIG. 10B is an upper rear view of the side seal according to the third embodiment of the developing cartridge illustrated in FIG. 1.

Conversely, the base material 41 according to the third embodiment has a slit 60 as illustrated in FIGS. 10A and 10B. The slit 60 is formed on the surface of the base material 41 toward the developing roller 3, in the thickness direction of the base material 41. The slit 60 is formed at the left-right direction middle of the surface of the base material 41, and extends in the rotational direction of the developing roller 3. The slit 60 is formed from the surface of the base material 41 to a certain depth. In a project view, the slit 60 matches the position of the first seal outer edge 45A, second seal inner edge 47B, first adhesive outer edge 46A, second adhesive inner edge 48B.

Thus, with the developing cartridge 1 according to the third embodiment, the surface portion of the base material 41 toward the developing roller 3 side which is on the inward side in the left-right direction can be vibrated along with the first upper layer portion 42. Also, the surface portion of the base material 41 toward the developing roller 3 side which is on the outward side in the left-right direction can be vibrated along with the second upper layer portion 43.

Thus, the first upper layer portion 42 and second upper layer portion 43 can be allowed to vibrate more, separately.

As a result, separate vibration of the first upper layer portion 42 and second upper layer portion 43 in a case where the developing cartridge 1 is subjected to impact can be realized in a more sure manner.

(3) Developing Cartridge According to Fourth Embodiment

The first seal layer 45 has been described in the above-described first embodiment as having multiple first grooves 45C, and the second seal layer 47 as having multiple second grooves 47C.

Figure 11A:
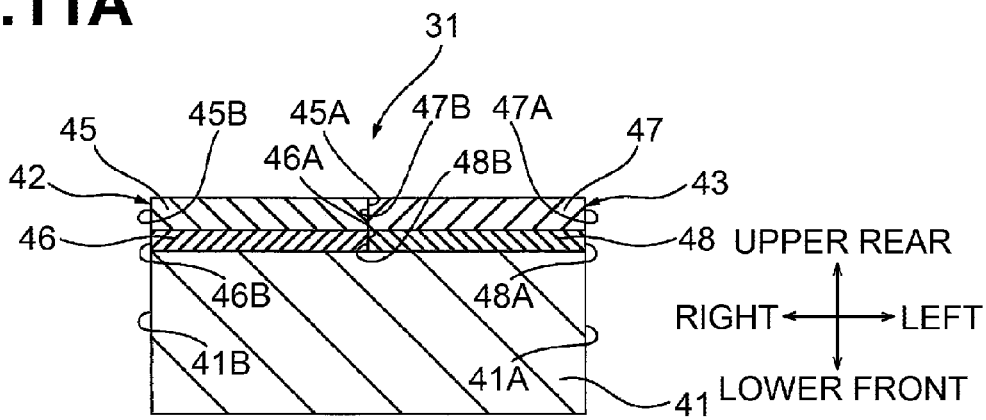
FIG. 11A is a cross-sectional view of a side seal according to a fourth embodiment of the developing cartridge illustrated in FIG. 1.
Figure 11B:
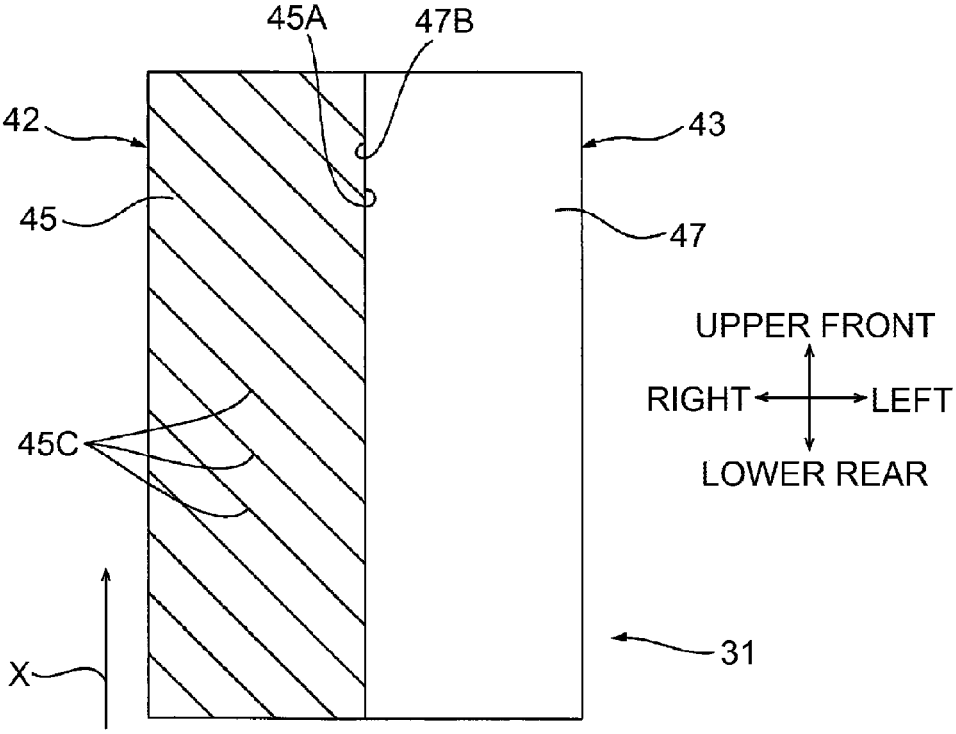
FIG. 11B is an upper rear view of the side seal according to the fourth embodiment of the developing cartridge illustrated in FIG. 1.

Conversely, the fourth embodiment has the multiple grooves formed only on the first seal layer 45, out of the first seal layer 45 and second seal layer 47, as illustrated in FIGS. 11A and 11B. That is to say, the first seal layer 45 has the multiple first grooves 45C formed, but the second seal layer 47 does not have multiple grooves formed on the surface thereof.

Thus, the developing cartridge 1 according to the fourth embodiment has multiple first grooves 45C formed on the first seal layer 45, but the second seal layer 47 does not have multiple grooves formed on the surface thereof.

Accordingly, the configuration of the side seal 31 can be simplified.

(4) Developing Cartridge According to Fifth Embodiment

The first seal layer 45 has been described in the above-described first embodiment as the side seal 31 having the base material 41, first seal layer 45, first adhesive layer 46, second seal layer 47, and second adhesive layer 48, with the first seal layer 45 and second seal layer 47 being configured as separate members.

Figure 12A:
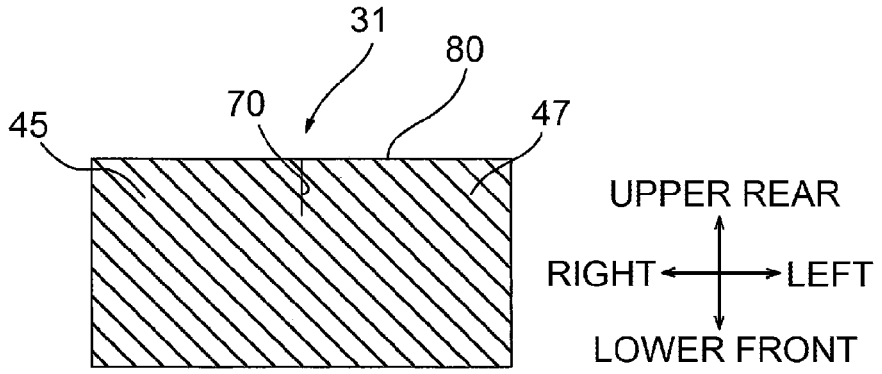
FIG. 12A is a cross-sectional view of a side seal according to a fifth embodiment of the developing cartridge illustrated in FIG. 1.
Figure 12B:
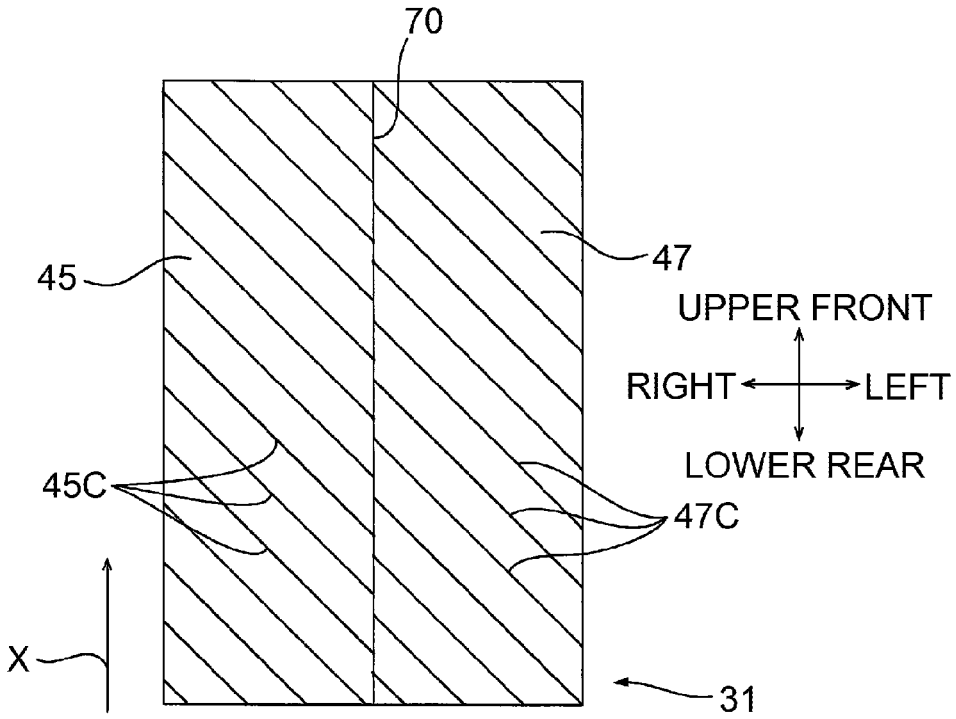
FIG. 12B is an upper rear view of the side seal according to the fifth embodiment of the developing cartridge illustrated in FIG. 1.

On the other hand the fifth embodiment has a single seal layer 80 for the side seal 31, as illustrated in FIGS. 12A and 12B.

The seal layer 80 has a slit 70. The slit 70 is formed at the left-right direction middle of the surface of the seal layer 80. The slit 70 is formed extending in the direction of rotation of the developing roller 3. In a state viewed from above, the slit 70 is formed partway from the upper edge to the lower edge of the seal layer 80. The slit 70 is cut to a certain depth from the surface of the seal layer 80 toward the lower front.

Accordingly, the inner portion in the left-right direction of the surface portion of the seal layer 80 toward the developing roller 3 side, with the slit 70 as a boundary, is formed as the first seal layer 45. Also, the outer portion in the left-right direction of the surface portion of the seal layer 80 toward the developing roller 3 side, with the slit 70 as a boundary, is formed as the second seal layer 47.

Thus, with the developing cartridge 1 according to the fifth embodiment, the side seal 31 can be formed such that the first seal layer 45 and second seal layer 47 are configured integrally with the seal layer 80.

Accordingly, the configuration of the side seal 31 can be simplified.

(5) Developing Cartridge According to Sixth Embodiment

The first embodiment has been described above as the second seal outer edge 47A being situated outward from the developing roller edge 3C of the developing roller 3, and the second seal inner edge 47B inward from the developing roller edge 3C of the developing roller 3.

Figure 13:
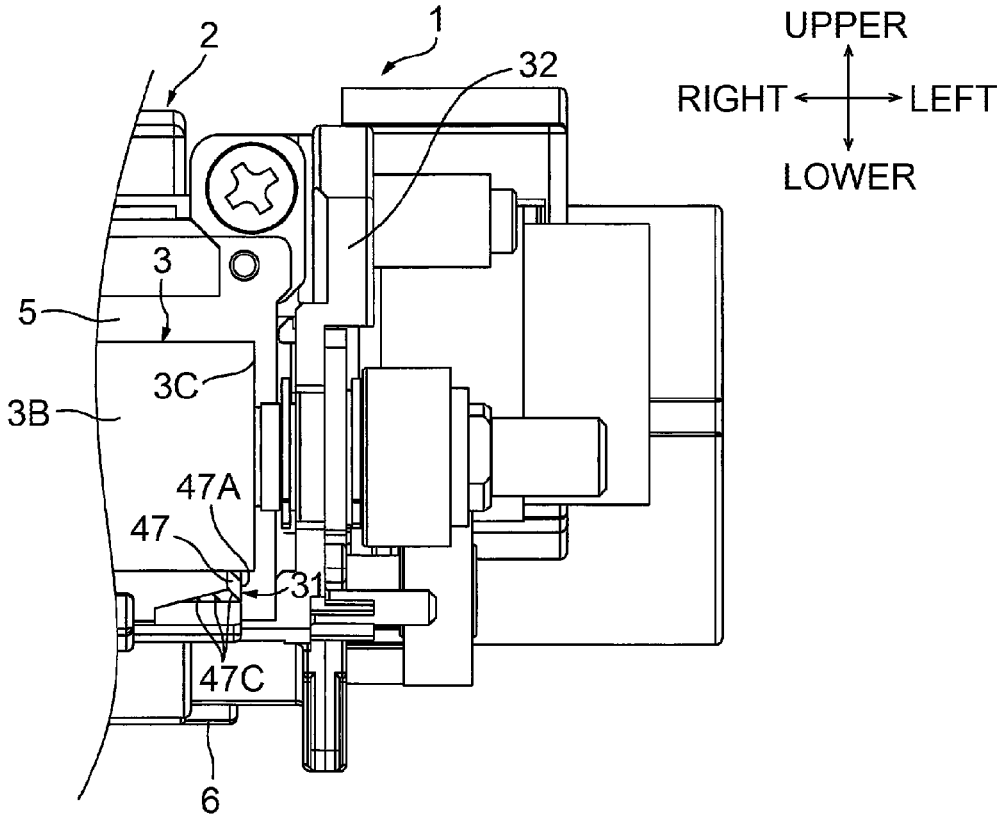
FIG. 13 is a rear view illustrating a left end portion according to a sixth embodiment of developing cartridge illustrated in FIG. 1.

Conversely, according to a sixth embodiment, the second seal outer edge 47A is situated on the inner side of the developing roller edge 3C of the developing roller 3 in the left-right direction, as illustrated in FIG. 13.

Thus, with the developing cartridge 1 according to the sixth embodiment, the first seal layer 45 and the second seal layer 47 can be pressed against the developing roller 3 in a sure manner.

Accordingly, the first seal layer 45 and second seal layer 47 can be pressed by the developing roller 3 in a well-balanced manner.

Consequently, gaps can be prevented from occurring between the first seal layer 45 and the developing roller 3 or the second seal layer 47 and the developing roller 3.

10. Other Embodiments

The developing cartridge 1 according to the first embodiment has been described as being detachably mountable to the drum cartridge 20

However, the developing cartridge 1 may be formed integrally with the drum cartridge 20. In this case, the developing roller 3, supply roller 4, layer thickness regulating blade 5, toner accommodation unit 8, photosensitive drum 21, and scorotron charger 22 are provided to a single process frame.

This enables the configuration of the process unit 13 to be simplified.

Also, the developing cartridge 1 according to the first embodiment has been described as being detachably mountable to the apparatus main unit 12.

However, the developing cartridge 1 may be assembled to the apparatus main unit 12.

This configuration enables the developing cartridge 1 to be held in a stable manner.

What is claimed is:

1. A developing unit comprising:

a housing configured to accommodate therein a developing agent;

a developing roller disposed in the housing and configured to rotate on a first axial line; and a seal disposed in the housing and contacting an outer peripheral surface of the developing roller, wherein the seal comprises:

a first part disposed inward in an axial line direction of the developing roller and contacting the outer peripheral surface of the developing roller; and a second part contacting an outer edge of the first part in the axial line direction, disposed outward from the first part in the axial line direction and contacting the outer peripheral surface of the developing roller, wherein the first part has a contact surface contacting the developing roller and a plurality of first grooves each of which is recessed from the contact surface and extends along the contact surface, wherein the plurality of first grooves extends from outward to inward in the axial line direction, as the plurality of first grooves extends from upstream to downstream in a rotational direction of the developing roller, wherein the second part has a plurality of second grooves formed on a contact surface contacting the developing roller, wherein the plurality of second grooves extend from outward to inward, from upstream to downstream in the rotational direction of the developing roller, and wherein the outer edge of the plurality of first grooves in the axial line direction is positioned at a different position from an inner edge of the plurality of second grooves in the axial line direction.

2. The developing unit according to claim 1, wherein an outer edge of the second part is positioned further outward from an outer edge of the developing roller in the axial line direction, and wherein an inner edge of the second part is positioned inward from the outer edge of the developing roller in the axial line direction.

3. The developing unit according to claim 1, wherein the outer edge of the second part is positioned inward from the outer edge of the developing roller in the axial line direction.

4. The developing unit according to claim 1, wherein the first part is separate from the second part.

5. The developing unit according to claim 1, wherein each of the first part and the second part has a predetermined thickness, wherein the developing unit further comprises a base material layer which is elastically deformable in a thickness direction orthogonal to the axial line direction, the base material layer being disposed at an opposite side of the first part and second part from the developing roller, wherein the first part is disposed between an inner portion in the axial direction of the base material layer and the developing roller in the thickness direction, and wherein the second part is disposed between an outer portion in the axial direction of the base material layer and the developing roller in the thickness direction.

6. The developing unit according to claim 5, wherein the first part comprises:

a first surface layer disposed toward the developing roller in the thickness direction, a surface of which has the plurality of first grooves; and a first adhesive layer disposed between the first surface layer and the base material layer in the thickness direction and configured to adhere the first surface layer to the base material layer, and wherein the second part comprises:

a second surface layer disposed toward the developing roller in the thickness direction, a surface of which has the plurality of second grooves; and a second adhesive layer disposed between the second surface layer and the base material layer in the thickness direction and configured to adhere the second surface layer to the base material layer.

7. The developing unit according to claim 1, wherein each of the plurality of first grooves has a linear shape.

8. A developing unit comprising:

a developing roller configured to rotate about an axis line extending in a predetermined direction; and a seal contacting an outer peripheral surface of the developing roller and comprising:

a base layer which is elastically deformable; and a surface layer contacting the outer peripheral surface of the developing roller and adhesively bonded to the base layer, wherein the surface layer and the base layer have a slit extending in a rotational direction of the developing roller, and wherein the surface layer has a plurality of grooves extending from outward to inward in the predetermined direction, as the plurality of first grooves extending from upstream to downstream in a rotational direction of the developing roller.

9. The developing unit according to claim 8, further comprising an adhesive layer disposed between the surface layer and the base layer;

wherein the adhesive layer has the slit.

10. The developing unit according to claim 8, wherein a length of the slit in the rotational direction of the developing roller is equal to a length of a portion of the surface layer contacting the outer peripheral surface of the developing roller.

11. The developing unit according to claim 8, wherein an outer edge of the seal is positioned further outward from an outer edge of the developing roller in the predetermined direction, and wherein the slit is formed inward from the outer edge of the developing roller in the predetermined direction.

12. The developing unit according to claim 8, wherein the surface layer has a first edge positioned toward upstream in the rotational direction of the developing roller and a second edge positioned toward downstream in the rotational direction of the developing roller, and wherein the slit extends from the first edge to the second edge in the rotational direction.

13. The developing unit according to claim 8, wherein the plurality of grooves is formed only an inner side of the surface layer with respect to the slit in the predetermined direction.

14. The developing unit according to claim 8, wherein the slit is formed in a middle portion of the surface layer in the predetermined direction.

15. The developing unit according to claim 8, wherein each of the plurality of grooves has a linear shape.

16. The developing unit according to claim 8, wherein the slit has a linear shape.

* * * * *